US007625488B2

(12) United States Patent
Blackburn

(10) Patent No.: US 7,625,488 B2
(45) Date of Patent: Dec. 1, 2009

(54) WASTE WATER STRAINER

(76) Inventor: Dale M Blackburn, 15420 Weeks Dr., Whittier, CA (US) 90604

( * ) Notice: Subject to any disclaimer, the term of this patent is extended or adjusted under 35 U.S.C. 154(b) by 637 days.

(21) Appl. No.: 11/203,063

(22) Filed: Aug. 15, 2005

(65) Prior Publication Data

US 2007/0033731 A1 Feb. 15, 2007

(51) Int. Cl.
*E03C 1/282* (2006.01)

(52) U.S. Cl. ..... 210/308; 4/679; 4/292; 210/311; 210/312

(58) Field of Classification Search ..... 4/679, 4/286, 292, DIG. 14, DIG. 19; 210/308, 210/311, 312, 453, 435; 220/324
See application file for complete search history.

(56) References Cited

U.S. PATENT DOCUMENTS

| | | | | | |
|---|---|---|---|---|---|
| 242,270 | A | * | 5/1881 | Campbell | 220/324 X |
| 599,663 | A | * | 2/1898 | Sieben | 210/453 X |
| 661,931 | A | * | 11/1900 | Hayes | 210/312 X |
| 960,901 | A | | 6/1910 | Hall | |
| 1,248,996 | A | * | 12/1917 | Beck | 210/312 |
| 1,631,822 | A | * | 6/1927 | Jahn | 210/308 |
| 1,817,376 | A | | 8/1931 | Izquierda | |
| 2,661,096 | A | * | 12/1953 | Tinker | 210/308 |
| 2,798,613 | A | * | 7/1957 | Tinker | 210/453 X |
| 3,742,524 | A | | 7/1973 | Ballentine | |
| 4,045,351 | A | | 8/1977 | Peterson | |
| 4,164,048 | A | | 8/1979 | Kampfer et al. | |
| 4,179,762 | A | | 12/1979 | Barnhardt et al. | |
| 4,199,827 | A | | 4/1980 | Tuleja | |
| 4,207,631 | A | | 6/1980 | Baggey | |
| 4,340,470 | A | * | 7/1982 | Van Mol | 210/94 |
| 5,038,816 | A | | 8/1991 | Weltsch | |
| 5,241,979 | A | | 9/1993 | Chang | |
| 5,397,464 | A | | 3/1995 | Hannon | |
| 6,088,843 | A | | 7/2000 | Francico | |
| 6,153,095 | A | | 11/2000 | Francisco | |
| 6,263,518 | B1 | | 7/2001 | Magtanong | |
| 6,308,350 | B1 | | 10/2001 | Marchionda | |
| D462,422 | S | | 9/2002 | Conner | |

FOREIGN PATENT DOCUMENTS

| | | |
|---|---|---|
| EP | 0149729 A2 | 7/1985 |
| WO | WO 85/05390 | 12/1985 |

OTHER PUBLICATIONS (Internet) Majic Drain, Shor International Corp. 7 pages wesite: httP:/ShoreInternational>conm/gold recovery, printed Nov. 30, 2004.

* cited by examiner

*Primary Examiner*—Robert M Fetsuga
(74) *Attorney, Agent, or Firm*—Richard C. Litman

(57) ABSTRACT

A unitary plumbing apparatus is disclosed that serves as a drain waste water strainer trap for sinks and other plumbing fixtures as well as a filter or strainer for the exiting waste water to keep the drain pipe free flowing or to recover valuables lost into drain lines. The filter or strainer can be removed from the apparatus for cleaning by removing a cap at the bottom of the apparatus. The cap can be removed by hand. The top and bottom sections of the body of one embodiment of the apparatus are mutually rotatable for convenience in connecting inlet and outlet apparatus conduits to standing plumbing drain piping.

3 Claims, 8 Drawing Sheets

WASTE WATER STRAINER

FIELD OF THE INVENTION

The invention relates to plumbing apparatuses, and particularly to plumbing drainage devices employed in residential, commercial and industrial applications such as sinks, bath tubs, showers, pools, clothes washing machines, liquid storage or transfer tanks and industrial manufacturing wash tanks. The invention especially relates to those drainage devices incorporating structures that readily allow removal and recovery of solid materials suspended in the draining liquid, usually water.

DESCRIPTION OF THE RELATED ART

Drainage devices installed in plumbing lines and incorporating a structure to remove and recover particles or objects suspended in the drainage fluid are well known in the art. It is a commonplace experience in the home to have all kinds of objects from small toys such as marbles to diamond rings falling into the sink or tub, and wind up being washed into an unprotected drainpipe. The result is an expensive plumbing repair job to recover the expensive item or to open up an otherwise clogged drain. In residential homes and some commercial businesses such as beauty parlors, hair can accumulate in the drain trap and requires costly service calls by a plumber. The lesson learned is that drain lines from plumbing fixtures should be protected with an apparatus such as a readily accessible waste water strainer installed in the drain line that will capture the foreign object for easy recovery.

Of the devices known in the prior art, the challenge to provide a fully functioning drain catcher that is easy to install, easy to open up and is clean, economical and corrosion resistant has not been met. Some drain catchers are well engineered but require the skills of a master mechanic with pipe wrenches to open the device and remove the strainer to clean it and recover the trapped object(s). This defeats the goal of an economical devise. Indeed, some commonly available drain catchers are manufactured from cast iron at very high cost, simply because the multifunctional engineering requirements of a drain catcher are a difficult challenge to meet if the device is designed and manufactured from other engineering construction materials.

U.S. Pat. No. 4,045,351 to Peterson discloses a disposable strainer device for mounting in the bottom of a sink. The strainer device is an elongated cylinder sleeve in communication with the bottom of the sink and with an opening in the bottom of the cylinder. The sleeve contains an elongated perforated receptacle holder to receive the accumulated garbage. The holder can be removed for cleaning by passing it upward through the sink drain or removed downward by unbolting the end cap attached to the cylindrical container. Notably, in the instant invention, removal of the strainer is accomplished by merely removing the end cap by turning the cap, since it is not bolted to the cylinder.

In U.S. Pat. No. 4,199,827 to Tuleja, U-shaped drain traps are provided wherein the strainer means is disposed within the trap for particle capture. Access means are provided so the strainer can be withdrawn or placed within the trap in a vertical or horizontal section of the trap. The access means are bolted to the trap outlet and not fixed to the trap by a readily removable cap means as in the instant invention.

SUMMARY OF THE INVENTION

The waste water strainer (WWS) apparatus of the instant invention is installed in the residential, commercial or industrial plumbing liquid waste disposal system at a location proximate to the plumbing fixture(s) it is designed to serve. If preferred, the WWS apparatus can be attached directly onto the drain outlet of the plumbing fixture. As installed, the WWS replaces the need to install the ubiquitous drain trap that prevents sewer gasses from escaping into a dwelling; the design of the waste water strainer serves that purpose equally as well.

In a first embodiment of the waste water strainer of the instant invention the body of the WWS apparatus of the invention comprises an elongated cylinder, nominally about seven to eight inches long and about three to four inches in diameter, or larger; open at the circular top and bottom ends and preferably threaded at the top end to accommodate a treaded, circular clean-out plug affixed therein. There are two circular openings in the cylinder wall, one near the bottom of the cylinder to accommodate an inlet for waste water drainage fluid, and one near the top of the cylinder to accommodate an outlet for waste water drainage fluid subsequent to filtering through a strainer.

At the circular bottom edge of the cylinder, several short horizontal studs are in place around the cylinder edge that serve as one part of a means for anchoring a removable circular cap that seals the bottom of the cylinder. The removable cap itself contains several tapered hook-shaped vertical studs around the edge of the cap that correspond with the short studs at the bottom edge of the cylinder. The taper progresses from wide at the cap end of the hook to narrow at its terminus. When the cap is pressed against the bottom cylinder edge and rotated, the tapered hooks ride over the cylinder studs, and lock and seal the cap onto the bottom of the cylinder. The cap as locked onto the cylinder can be removed by turning with one's hand. No wrench is needed.

Near the bottom of the cylinder, the circular hole in the cylinder wall is used to securely connect a drain inlet pipe to the cylinder wall through which waste water drainage from the plumbing fixture drain can be admitted into the cylinder. The size and shape of the drain inlet pipe is determined by the need to freely permit the waste drainage fluid to pass into and collect in the bottom portion of the cylinder in an amount sufficient for the liquid in the cylinder bottom to cover the inlet hole in the cylinder wall, and thereby assure that sewage gasses do not escape from the cylinder into the dwelling via the drain inlet pipe. Preferably, the drain inlet fitting is an elbow-type plumbing fitting rising upward and connecting to the drain of the plumbing fixture through a conventional slip joint.

For the first embodiment of the invention, the hole in the cylinder wall near the top of the cylinder is preferably opposite to or at a right angle to the inlet hole on the cylinder and serves as an outlet for the drainage fluid subsequent to the fluid passing through a strainer. It is significant that the difference in the elevation of the outlet and inlet holes on the cylinder is great enough to assure that the liquid retained in the cylinder from the drainage flow seals the inlet hole and prevents sewer gasses from leaking up into the plumbing fixture and dwelling.

The cylinder of the WWS apparatus of the invention further contains an elongate strainer to filter the drainage fluid before exiting the cylinder. The length of the strainer conforms to the interior length of the cylinder and the diameter of the strainer is slightly less than the interior diameter of the cylinder along its length. In the first embodiment, the cross-sectional view of the strainer describes a very large arc, i.e. a circle, with a significant portion of the circumference open along the length of the strainer. The strainer is positioned in the cylinder such that the open portion of the circumference of the strainer is adjacent to the inlet opening in the cylinder wall whereby the flow of drainage fluid from the inlet is inclined toward the interior or middle portion of the strainer. As a result of the way the strainer is designed and positioned in the cylinder the drainage fluid must pass through the strainer before entering the outlet piping. As a consequence, solid materials in the drainage fluid are separated and collected.

The waste water strainer of the invention can be manufactured from a variety of materials including metals such as steel, brass or cast iron and plastic materials including engineering plastics such as nylon, polyethers, ABS and PET. Notably, the inventor has discovered a method to use inexpensive ABS plastic as a material for building the WWS apparatus without compromising the strength of the installed apparatus. By using fittings on the WWS manufactured by injection molding processes less expensive ABS pipe can be used for the body of the cylinder. The injection molded fittings reinforce the strength of the extruded ABS used for the body of the cylinder. Also, using injection molded fittings for the threaded, circular clean-out plug affixed to the top of the cylinder of the invention allows that opening to be strong enough to use a plumber's snake to open up clogged piping.

In a second embodiment of the waste water strainer apparatus of the invention the cylindrical body of the WWS is manufactured in two mating, mutually rotatable sections The cylindrical body of the WWS is divided into two separate sections of approximately equal outside diameters at a location between the inlet and outlet apertures of the cylinder as described for the first embodiment. During the WWS apparatus on-site installation, the two top and bottom sections of the second embodiment are rotatably press-fit together to yield a completed cylinder unit as in the first embodiment. However, as the sections can rotate through 300 degrees, the inlet and outlet piping of the WWS can now be exactly lined up with the in-place drain plumbing pipe from the fixture and the outlet plumbing pipe to the sewer. This simplifies the overall plumbing installation. Finally, the installed sections are sealed together with glue or other common means known in the art.

In the second embodiment of the invention, the strainer is designed such that the upper portion of the strainer in the location of the WWS outlet piping filters the waste water in the complete inner circumference in that area of the cylinder and the top of the strainer. In the immediate terminus of the inlet conduit portion in the cylinder the waste water enters the interior of the strainer before being filtered and the bottom of the strainer covers the bottom of the cylinder. The configuration of the strainer allows for its easy removal from the cylinder without interference from either the inlet or outlet conduit connections.

These and other features of the present invention will become readily apparent upon further review of the following specification and drawings.

DETAILED DESCRIPTION OF THE PREFERRED EMBODIMENTS

The waste water strainer of the invention fills the need for an apparatus that can replace the conventional waste water trap used down stream of sinks, tubs, etc., to seal out sewage gases from entering dwellings while the same unit filters out trash or expensive jewelry and the like that finds its way into the sink drawn or other plumbing fixtures. Typically, the waste material and other solids are removed by filtration of the waste water stream through a strainer which must be removed from the unit of the invention as well as prior art units for regular cleaning. Strainers in prior art traps are difficult to remove because the strainer outlet ports are threaded plugs requiring the services of a plumber or other skilled mechanic to remove without damaging the fixture. The WWS of the present invention eliminates that problem by providing two such outlets for the strainer removal, one a threaded plug on the top of a cylindrical fixture and the other a readily hand removable cap on the bottom of the fixture. The cap is affixed to the cylinder bottom of the cylinder by a unique slip lock arrangement.

Figure 1:
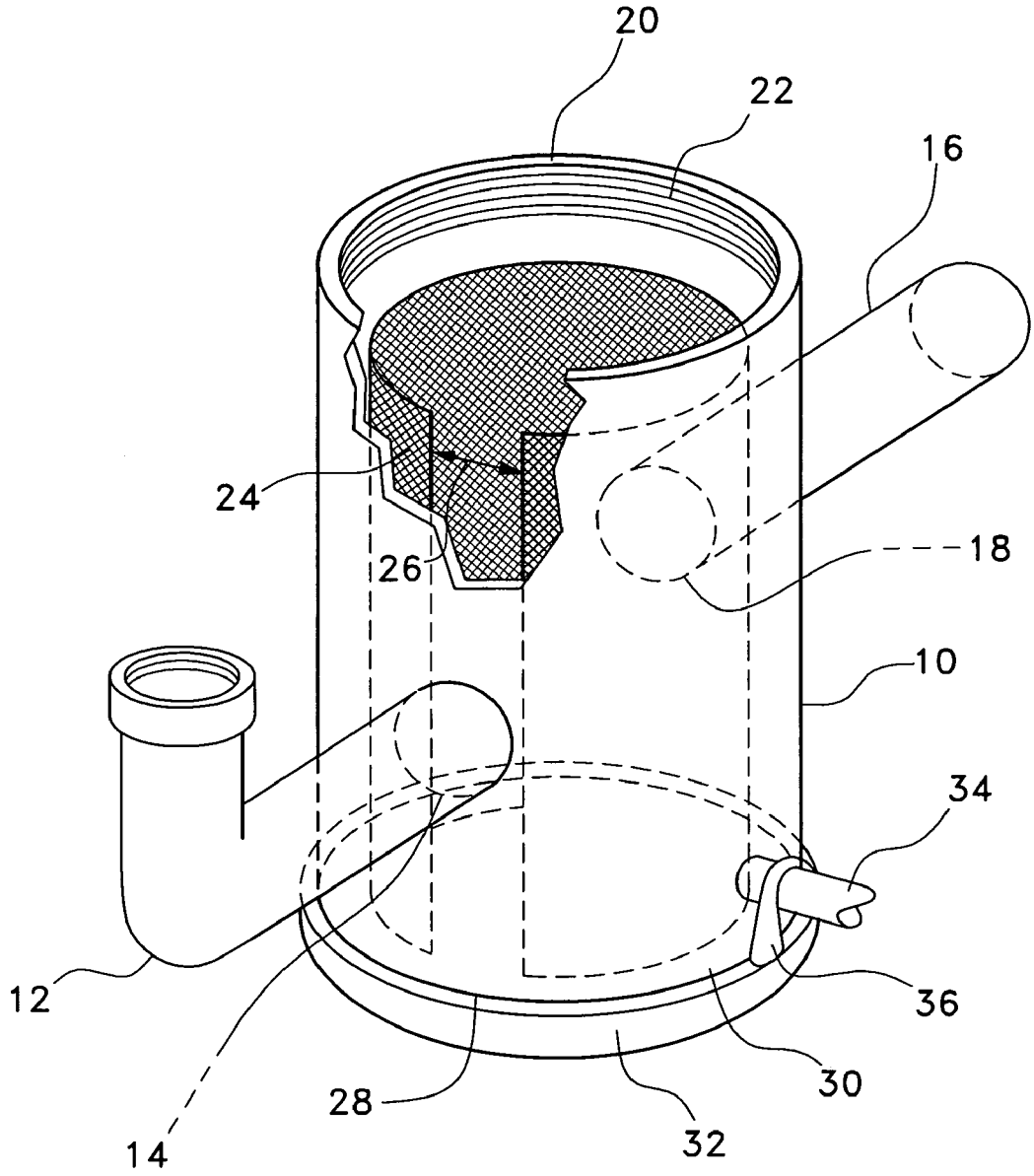
FIG. 1 is an elevated environmental perspective of the first embodiment of the drain waste water strainer of the invention.
Figure 2:
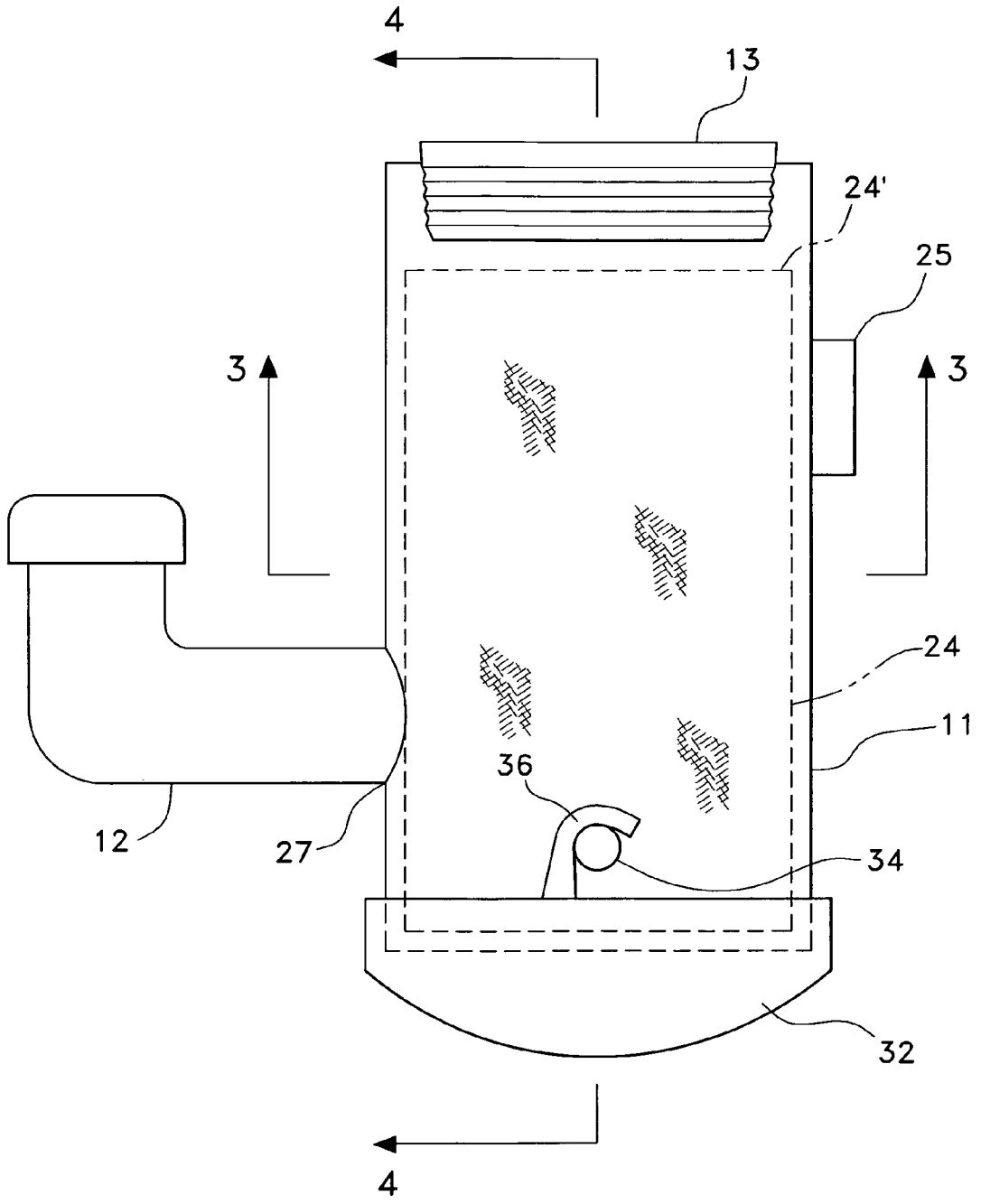
FIG. 2 is an elevated side view of the waste water strainer of FIG. 1.
Figure 3:
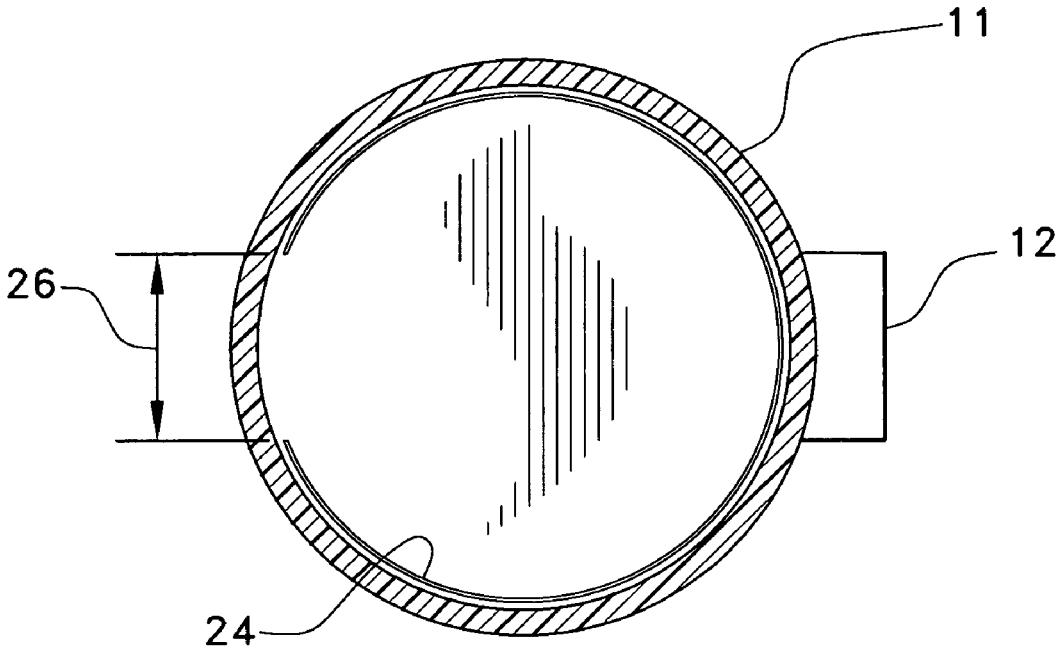
FIG. 3 is a cross-sectional view of the drain waste water strainer of FIG. 1 taken along line 3-3 of FIG. 2.
Figure 4:
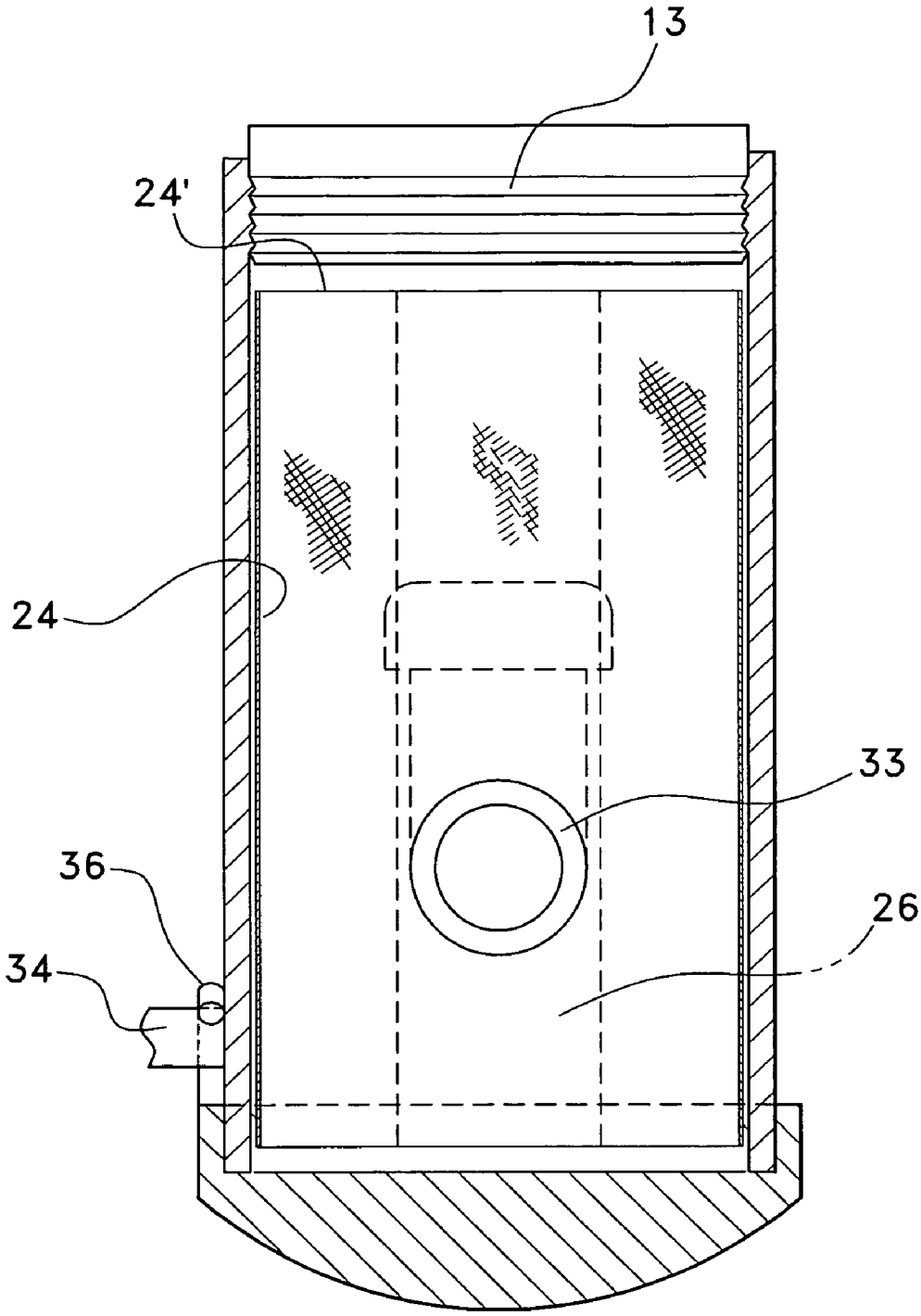
FIG. 4 is a cross-sectional view of the waste water strainer of FIG. 1 taken along line 4-4 of FIG. 2.

Referring to FIG. 1, a vertical perspective of the waste water strainer unit of the invention is presented. The dimensions of the cylinder of the unit and its appurtenances will vary proportionally depending upon the amount of wastewater issuing from the plumbing fixture the unit is servicing. In FIG. 1, the base unit is the cylinder with a continuous wall 10. A drain water inlet pipe conduit 12 is attached to the cylinder at a corresponding aperture 14 near the bottom of the cylinder. Similarly, an outlet pipe conduit 16 is attached to the unit by a corresponding aperture 18 near the top of the cylinder. The difference in height of the conduits assures that the water level in the cylinder will always be high enough to seal the inlet conduit from the back flow of sewage gasses. The top opening of the cylinder 20 is level and circular and internally threaded 22 in an amount sufficient to accommodate a removable male threaded plug to seal the top of the unit. The strainer 24 can be removed through the top opening and, once the strainer is removed, a plumber's snake can be fed into the outlet conduit to clean out the outlet conduit as necessary. The strainer 24 is circular in shape and covers the length of the cylinder up to the internal thread line with a diameter just less than the diameter of the cylinder. As shown in FIGS. 2 and 4, the top edge 24' of the strainer 24 is below the lowest extent of the internal threads 22 and top threaded plug 13.

Notably, the circumference of the strainer is not a closed circle from top to bottom. A portion of the circumference 26 is removed from top to bottom of the cylinder, thereby defining a circumferential opening. The absent portion of the circumference is just wider than the diameter of the inlet conduit so that the strainer can be removed without interference from the end of the inlet conduits 14.

The bottom edge of the cylinder 28 is sealed by cap 32. The bottom edge contains one or more studs 34 protruding from the cylinder wall 10. The outside edge of the cap holds and supports one or more hooks 36 that are tapered from tip to base and lock on to the studs 34 when the cap is rotated. Reverse rotation of the cap frees the hooks and the cap can be removed by hand to remove the strainer.

Referring to FIG. 2, an elevation side view of an intact WWS apparatus as taught in FIG. 1 is presented. The Figure further illustrates the WWS cylindrical container 11, the top threaded plug 13, the inlet conduit 12, the strainer 24, the bottom cap 32, and the hook 36 and stud 24 assembly that locks the cap 32 into place. The all-important strainer 24 is also shown. FIG. 2 also shows the outlet fitting 25 that connects with the outlet conduit. This fitting is preferably formed by injection molded ABS plastic, as is the plug 13 and the inlet fitting 27. ABS is an engineering plastic that forms strong plumbing fitting when shaped by injection molding or thermosetting.

It has been discovered that when thermoset ABS plastic fittings are used in the manufacture of the WWS, their strength and rigidity adds enough additional support to the body of the cylindrical container that less expensive extruded ABS pipe can be used to manufacture the body of the container. The savings in cost for the WWS is appreciable.

Referring to FIG. 4, a cross-sectional view of the WWS of the FIG. 1 taken along line 4-4 of FIG. 2. Looking toward the inlet side of the WWS apparatus from the center of the container, the physical relationship between the strainer 24, the strainer opening 26, and the inlet port 33 is depicted. The view also shows the closed position of the hook 36 and stud 34 combination and the inserted plug 13.

Figure 5:
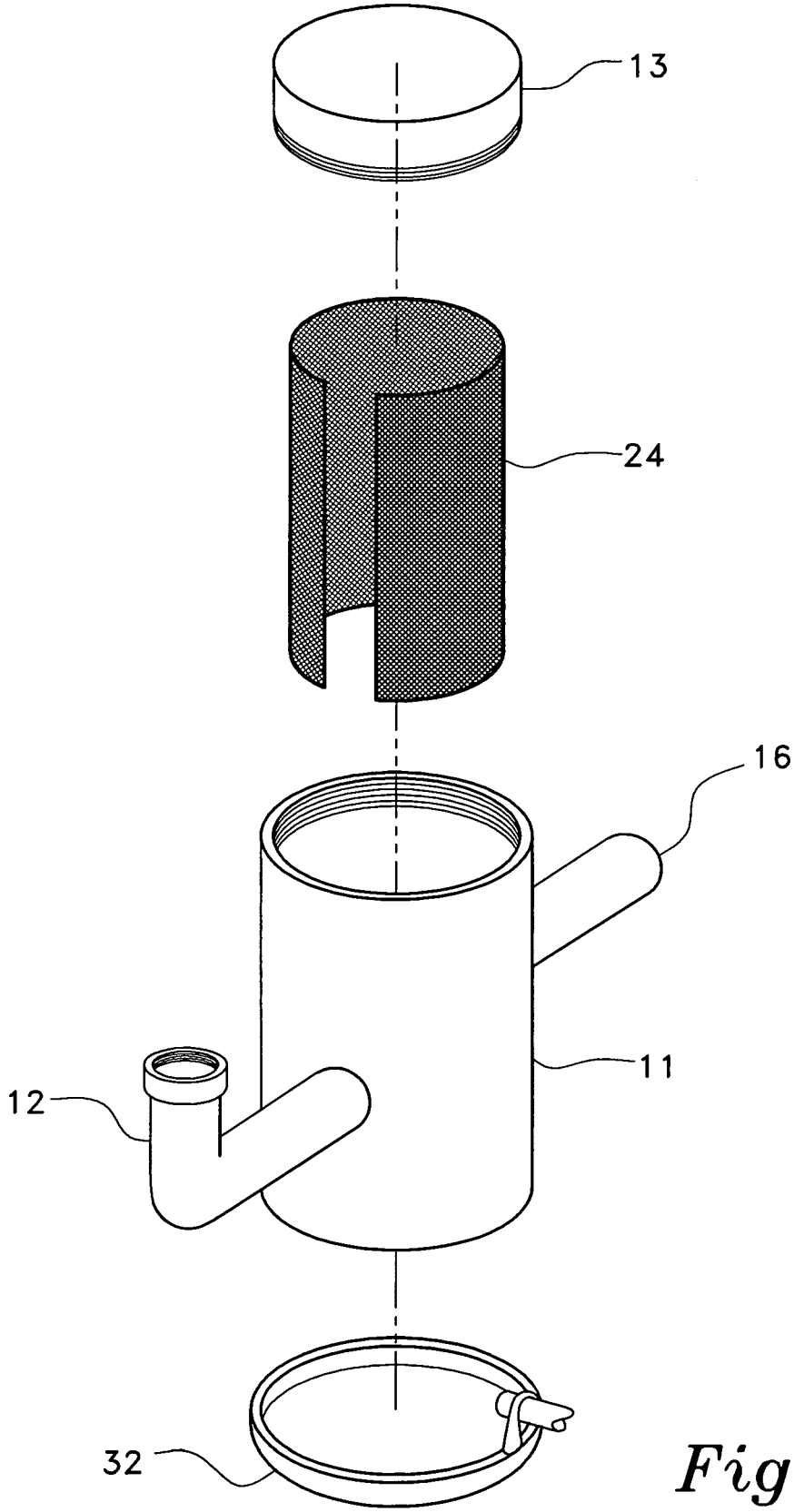
FIG. 5 is an exploded perspective view of the waste water strainer of FIG. 1.

Referring to FIG. 5, an exploded drawing view of the WWS of FIG. 1 is presented showing some main elements of the invention: the cylindrical container 11 of the drain catcher with outlet pipe 16 and inlet pipe 12, the strainer 24, and the screw-on top plug 13.

Figure 6:
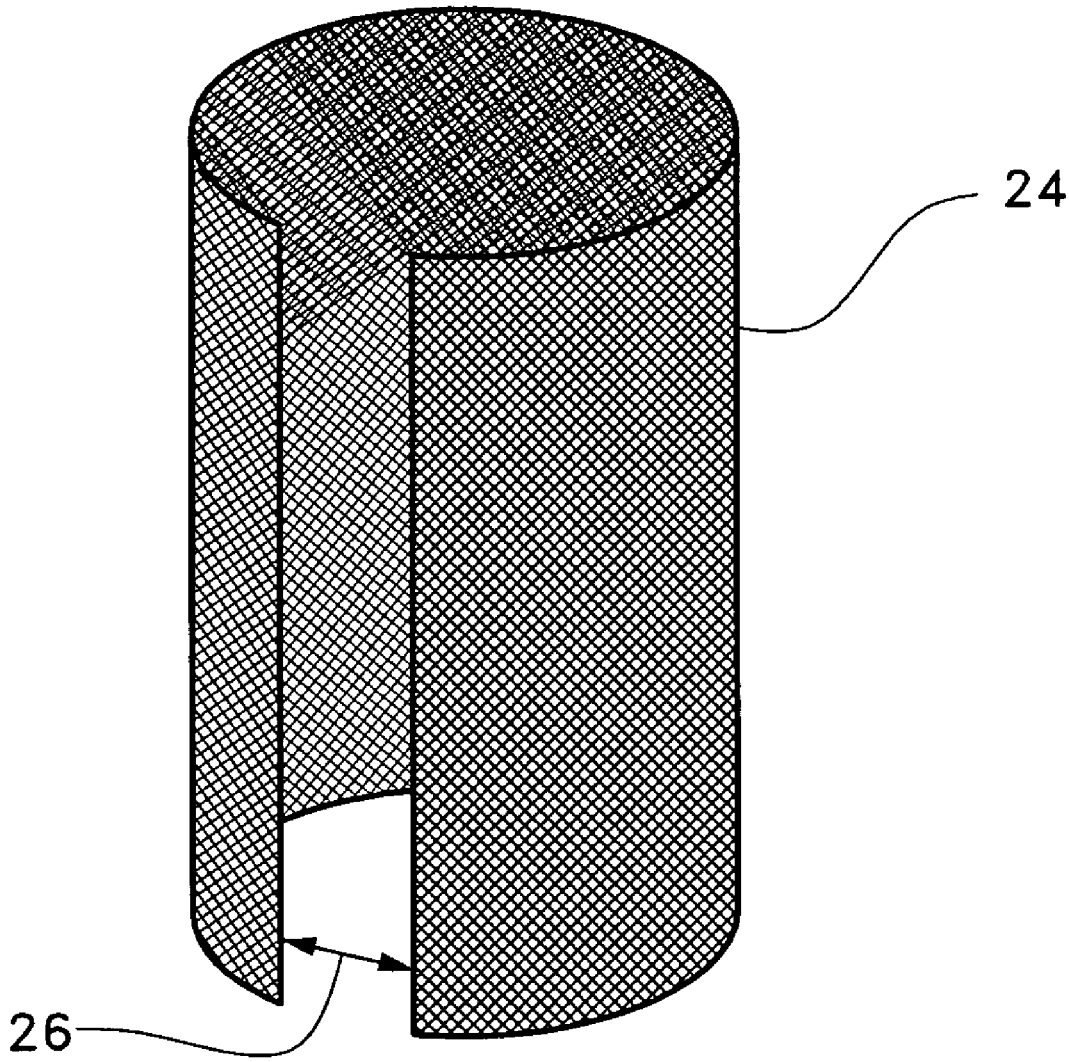
FIG. 6 is an elevated perspective view of the strainer of the waste water strainer depicted in FIG. 1.

Referring to FIG. 6, an elevated exposed view of the strainer of the WWS depicted in FIG. 1 is presented 24. Importantly, the circumference of the cylindrical strainer is slightly less than the interior circumference of the cylindrical body of the drain catcher apparatus. Also, FIG. 6 shows the important opening along the length of the strainer that permits easy removal from the cylindrical central chamber of the drain catcher.

Figure 7:
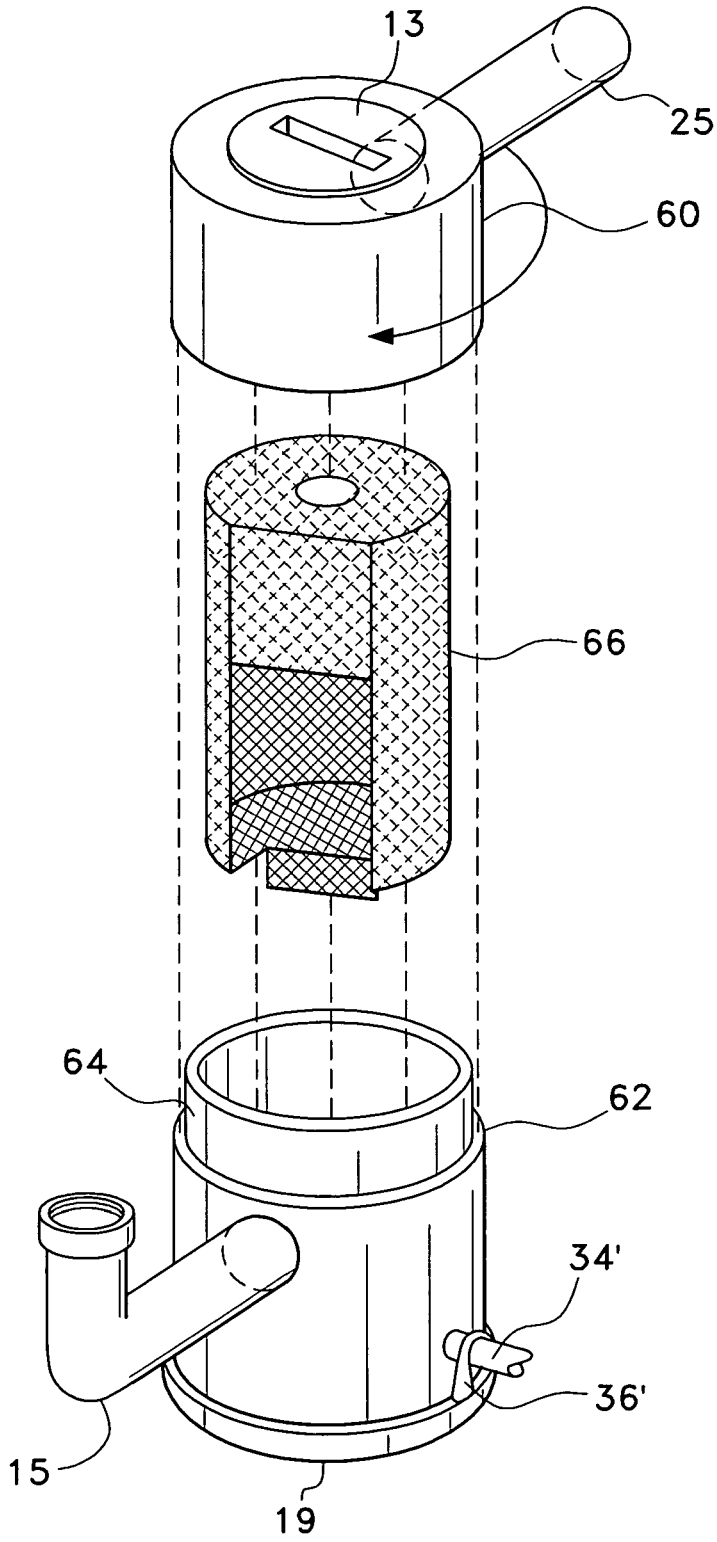
FIG. 7 is an exploded perspective side view of the second embodiment of the waste water strainer assembly.

Referring to FIG. 7, a second embodiment of the WWS is presented as an exploded perspective side view of the waste water strainer assembly. The FIG. 7 illustrates the WWS cylindrical container as two sections, 60 and 62, that are mutually rotatably mated when combined at cylinder collar 64. The top threaded plug 13 is revealed as is the inlet conduit 15 and the outlet conduit 25, the second embodiment strainer 66, the bottom press-fit cap 19, and the hook 36' and stud 34' assembly 21 that locks the cap into place. The rotatable sections of the second embodiment allows the mechanic to select the preferred angles of the inlet and outlet conduits of the assembly to be connected with the drain piping from the plumbing fixture and the sewer side plumbing conduit.

Figure 8:
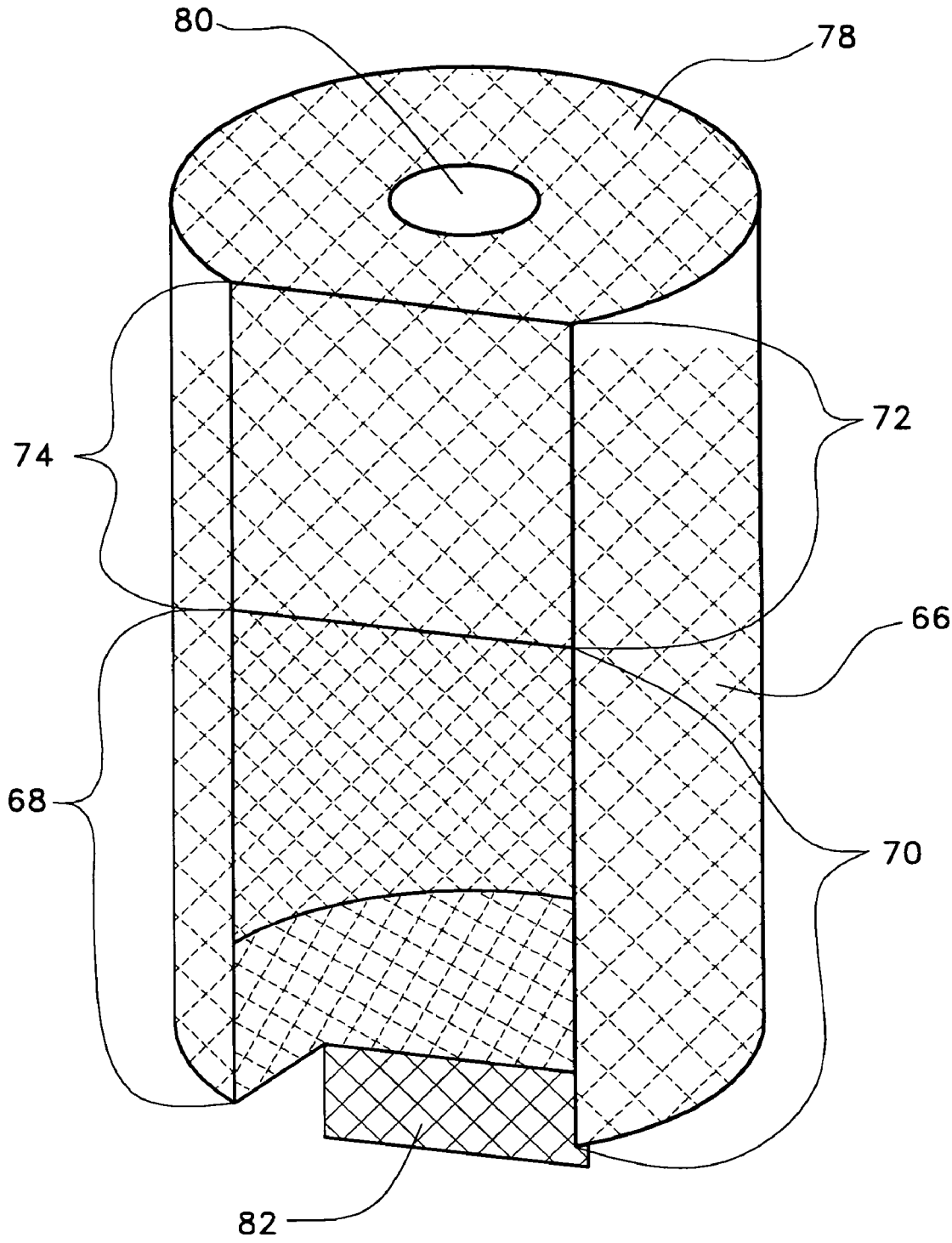
FIG. 8 is a side elevated perspective view of the strainer of the second embodiment of the waste water strainer apparatus Similar reference characters denote corresponding features consistently throughout the attached drawings.

Referring to FIG. 8, a side elevated perspective view of the strainer of the second embodiment or first embodiment of the waste water strainer apparatus is presented. The strainer 66 is a semi cylinder of metal mesh having a rectangular opening defined by 68 and 70 to accommodate the leading edge of the drain water inlet conduit. The rectangle defined by 72 and 74 is a flat section of metal mesh strainer. The semicircular top section 78 comprises metal mesh strainer having an aperture 80. The strainer rests on the cylinder bottom on a mesh section 82. As can be seen, the apparatus includes a semicylindrical metal mesh strainer extending from the plug fitting inner surface to the lower cap inner surface of the apparatus cavity, wherein the lower half side of the strainer proximate to the inlet aperture is devoid of metal mesh and the continuing upper half side comprises flat rectangular metal mesh connected to the edges of the semicylindrical strainer.

The design of the second embodiment strainer maximizes the surface area of metal mesh available for filtering the inlet drain water while still permitting easy removal of the strainer from the apparatus for cleaning.

The plumbing apparatus of the invention comprises a unitary combination of a drain trap and a drain water filtering system including a water proof container having a wall height greater than its width and circumferential openings in the extreme top and bottom sections wherein the extreme top opening is threaded to contain a threaded plug and the bottom opening edge contains one or more horizontal studs. Also, the apparatus of the invention includes side wall entrance aperture opening for passing a stream of unfiltered drain water into a bottom portion of said container; side wall exit aperture opening for passing a stream of filtered drain water out of a top portion of the container; and filter means positioned in the container between the extreme top and bottom of the container to filter the stream of unfiltered drain water; and a means to cover the circumferential bottom opening.

It is to be understood that the present invention is not limited to the embodiments described above, but encompasses any and all embodiments within the scope of the following claims.

I claim:

1. A cylindrical tubular plumbing apparatus comprising a unitary combination of a drain trap and a drain water filtering system, said apparatus including:

a stack comprising at least two sections of upper and lower interconnected cylinder sections, said sections being individually and jointly rotatable, said cylinder contains two interconnected individually rotatable cylinder body sections, wherein one of said cylinder body sections defines a reduced diameter collar to permit the other cylinder body section to rotate;

a side wall aperture opening in said lower cylinder section for passing a stream of unfiltered drain water into a bottom portion of the cylinder;

a side wall aperture opening in said upper cylinder section for passing a stream of filtered drain water out of a top portion of the cylinder;

a threaded plug fitting connected to the open top of the cylinder;

a hand-removable cap connected to the open bottom of the cylinder; and strainer means for filtering drain water, said strainer receivably interposed within the cylinder apparatus from the unfiltered drain water inlet and the top of the apparatus cavity, said strainer means including a semicylindrical metal mesh strainer extending from said plug fitting inner surface to said lower cap inner surface of the apparatus cavity, wherein the lower half side of the strainer proximate to the inlet aperture defines edges and is devoid of metal mesh and the continuing upper half side comprises flat rectangular metal mesh connected to the edges of the semicylindrical strainer.

2. The plumbing apparatus of claim 1, wherein said side wall apertures contain plumbing fittings suitable for connecting with wastewater drain pipe.

3. The plumbing apparatus of claim 1, wherein said lower cylinder section contains at least one horizontal stud and said hand-removable cap includes a hand-removable press fit cap, said cap having vertically rotatable hooks attached to the edge of the cap, to connect onto said at least one stud and removably lock the cap in place.

* * * * *